US005979578A

United States Patent [19]

Packer

[11] Patent Number: 5,979,578

[45] Date of Patent: Nov. 9, 1999

[54] MULTI-LAYER, MULTI-GRADE MULTIPLE CUTTING SURFACE PDC CUTTER

[75] Inventor: Scott M. Packer, Pleasant Grove, Utah

[73] Assignee: Smith International, Inc., Houston, Tex.

[21] Appl. No.: 08/869,781

[22] Filed: Jun. 5, 1997

[51] Int. Cl.[6] ..... E21B 10/46

[52] U.S. Cl. ..... 175/432; 175/434

[58] Field of Search ..... 175/432, 434, 175/428, 430, 431

[56] References Cited

U.S. PATENT DOCUMENTS

| | | | |
|---|---|---|---|
| 4,225,322 | 9/1980 | Knemeyer | 51/295 |
| 4,255,165 | 3/1981 | Dennis et al. | 51/309 |
| 4,339,009 | 7/1982 | Busby | 175/374 |
| 4,592,433 | 6/1986 | Dennis | 175/329 |
| 4,604,106 | 8/1986 | Hall et al. | 51/293 |
| 4,743,515 | 5/1988 | Fischer et al. | 428/698 |
| 4,823,892 | 4/1989 | Fuller | 175/329 |
| 4,984,642 | 1/1991 | Renard et al. | 175/430 |
| 5,031,484 | 7/1991 | Packer | 76/108.6 |
| 5,119,714 | 6/1992 | Scott et al. | 76/108.2 |
| 5,172,778 | 12/1992 | Tibbitts et al. | 175/420.1 |
| 5,205,684 | 4/1993 | Meskin et al. | 408/145 |
| 5,217,081 | 6/1993 | Waldenström et al. | 175/420.2 |
| 5,238,074 | 8/1993 | Tibbitts et al. | 175/428 |
| 5,248,006 | 9/1993 | Scott et al. | 175/420.2 |
| 5,335,738 | 8/1994 | Waldenstrom et al. | 175/420.2 |
| 5,351,770 | 10/1994 | Cawthrone et al. | 175/374 |
| 5,351,772 | 10/1994 | Smith | 175/428 |
| 5,379,853 | 1/1995 | Lockwood et al. | 175/428 |
| 5,431,239 | 7/1995 | Tibbitts et al. | 175/428 |
| 5,467,669 | 11/1995 | Stroud | 76/108.2 |
| 5,492,188 | 2/1996 | Smith et al. | 175/432 |
| 5,499,688 | 3/1996 | Dennis | 175/426 |
| 5,667,028 | 9/1997 | Truax et al. | 175/428 |
| 5,722,499 | 3/1998 | Nguyen et al. | 175/431 |

FOREIGN PATENT DOCUMENTS

| | | |
|---|---|---|
| 0156264 | 10/1985 | European Pat. Off. . |
| 0177466 | 4/1986 | European Pat. Off. . |
| 2190412 | 11/1987 | United Kingdom . |
| 2204625 | 11/1988 | United Kingdom . |

*Primary Examiner*—Hoang Dang
*Attorney, Agent, or Firm*—Christie, Parker & Hale, LLP

[57] ABSTRACT

An improved polycrystalline diamond composite ("PDC") cutter with secondary PDC cutting surfaces in addition to a primary PDC cutting surface is formed comprising of at least two wafers of cemented carbide bonded together. The secondary cutting surfaces are formed by compacting and sintering diamond in grooves formed at the surface of the wafers. Wafers of different grades of cemented carbide may be used. Moreover, different grades of diamond may be compacted and sintered in different grooves.

28 Claims, 4 Drawing Sheets

FIG. 1
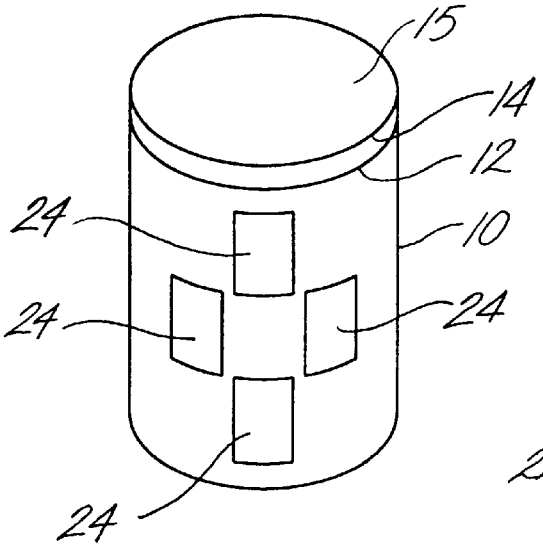
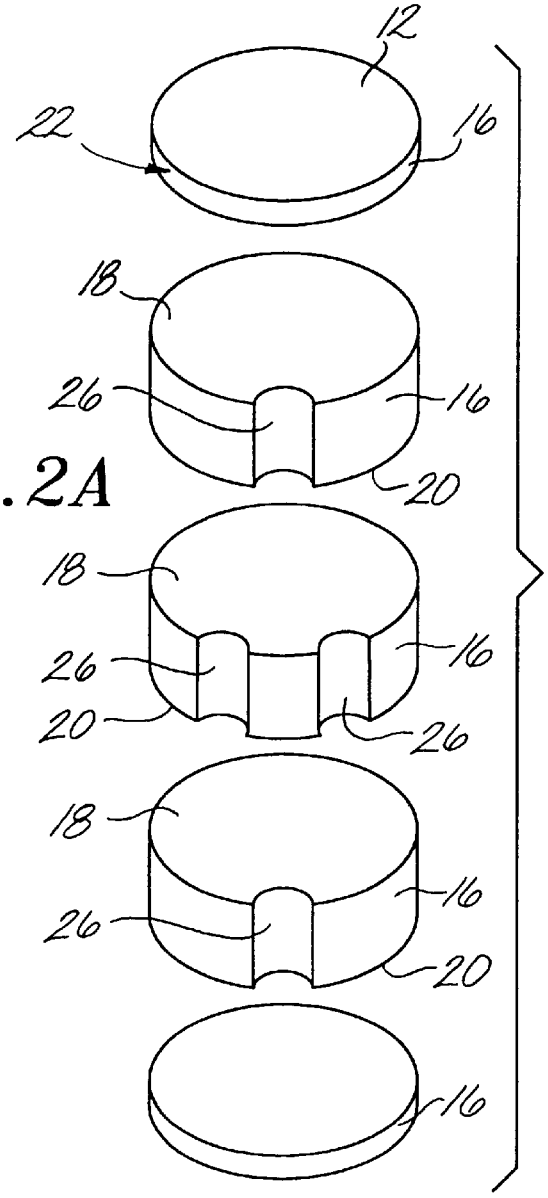
FIG. 2A

MULTI-LAYER, MULTI-GRADE MULTIPLE CUTTING SURFACE PDC CUTTER

BACKGROUND OF THE INVENTION

The present invention relates to polycrystalline diamond composite ("PDC") cutters with multiple cutting surfaces used in drag bits for drilling bore holes in earth formations.

PDC cutters have a cemented carbide body and are typically cylindrical in shape. The primary cutting surface of the cutter is formed by sintering a PDC layer to a face of the cutter. Secondary cutting surfaces are formed on the cutter body by packing grooves formed on the cutter surface with diamond and then sintering the diamond to form polycrystalline diamond cutting surfaces.

The cutters are inserted on a drag bit outer body exposing at least a portion of the cutter body and the diamond cutting surface. Typically, the cutter makes contact with a formation at an angle, i.e., the diamond cutting layer is at an angle to the formation surface. As the bit rotates, the PDC cutting layer edge makes contact and "cuts" away at the formation. At the same time portions of the exposed cutter body also make contact with the formation surface. This contact erodes the cutter body surrounding the secondary cutting surfaces, revealing a secondary surface cutting edge or wear surface.

One preferable way to prolong the life of a cutter during drilling, is to increase the hardness of the substrate forming the cutter body. The increase in hardness tends to provide a stiffer or more rigid support for the PDC cutting surface. This will help reduce the magnitude of the tensile stresses in the PDC cutting surface induced by a bending moment during the cutting action, thereby reducing the frequency of cracks in the PDC layer which run perpendicular to the interface. However, a stiffer, harder substrate typically has a lower fracture toughness value and in some cases a lower transverse rupture strength. As a result, once a crack is initiated in the PDC, the substrate is unable to slow the propagation. If a crack is allowed to propagate, it can cause the cutter to fracture and fail catastrophically resulting in the eventual failure of the bit.

Accordingly, there is a need for a cutter having secondary cutting surfaces with an increased resistance to breakage. Moreover, there is a need for a cutter having a stiff, hard substrate supporting the cutter cutting layer for improved cutting but which prevents the propagation of crack growth through the cutter body.

SUMMARY OF THE INVENTION

The present invention is an improved polycrystalline diamond composite ("PDC") cutter having multiple cutting surfaces and a body which is composed of at least two grades of carbide; and a method for making the same. In a preferred embodiment, a cutter body or substrate is formed from layers of carbides. For descriptive purposes, the substrate layers are also referred to as "wafers." Each wafer has a top end, a bottom end and a body therebetween.

The cutter body is formed by bonding the wafers of cemented carbide together, one on top of the other. It is preferred that a stiffer grade cemented carbide is used to form the uppermost portion of the cutter which interfaces with the primary PDC cutting layer. A stiffer substrate provides better support for the cutting layer which results in enhanced cutting.

Secondary cutting surfaces are formed by compacting and sintering diamond in grooves formed on the body surface of the wafers. The grooves preferably span the length of the wafers. The grooves can be of any shape. Generally, the shape and orientation of the grooves is dictated by the formations to be cut. In addition, the orientation of the grooves, and hence, of the secondary cutting surfaces, may be varied by rotating the wafers in relation to each other. For example, the wafers may be oriented such that the grooves on their surfaces are aligned for forming grooves that are continuous between the wafers. Moreover, different grades of diamond may be compacted and sintered in different grooves.

BRIEF DESCRIPTION OF THE DRAWINGS

FIG. 1 is an isometric view of a PDC cutter with secondary cutting surfaces.

FIG. 2A is an isometric view of five cemented carbide wafers, three of which having grooves, which when bonded form the PDC cutter body of FIG. 1.

DETAILED DESCRIPTION OF THE PREFERRED EMBODIMENT

Figure 2B:
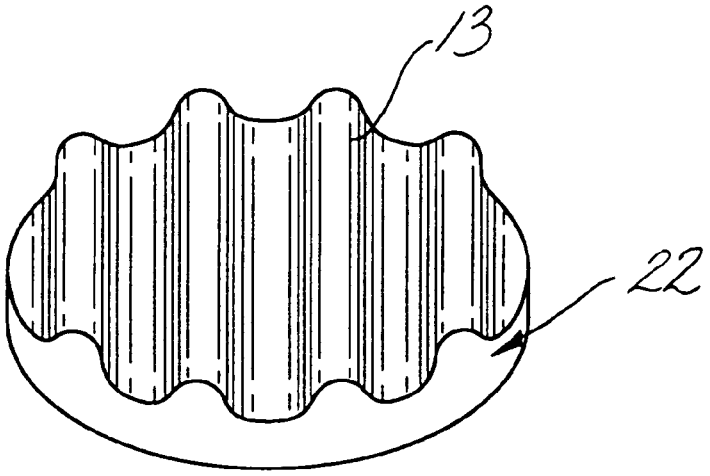
FIG. 2B is an isometric view of a PDC cutter uppermost wafer having a non-planar surface for bonding the PDC layer.

Generally, PDC cutters have a carbide body 10 having a cylindrical shape with a cutting face 12 (FIG. 1). A PDC layer 14 is sintered on the cutting face of the body (FIG. 1). While the present invention is described herein based on a cylindrical-shaped cutter, the invention is equally applicable to other shapes of cutters.

The body of the PDC cutter is formed by bonding together at least two cemented carbide wafers 16. The wafers are preferably cylindrical having a top 18 and bottom 20 end and a body having a circumferential outer surface therebetween (FIG. 2A). To form the cutter body, the wafers are preferably stacked one on top of the other and bonded.

Figure 6:
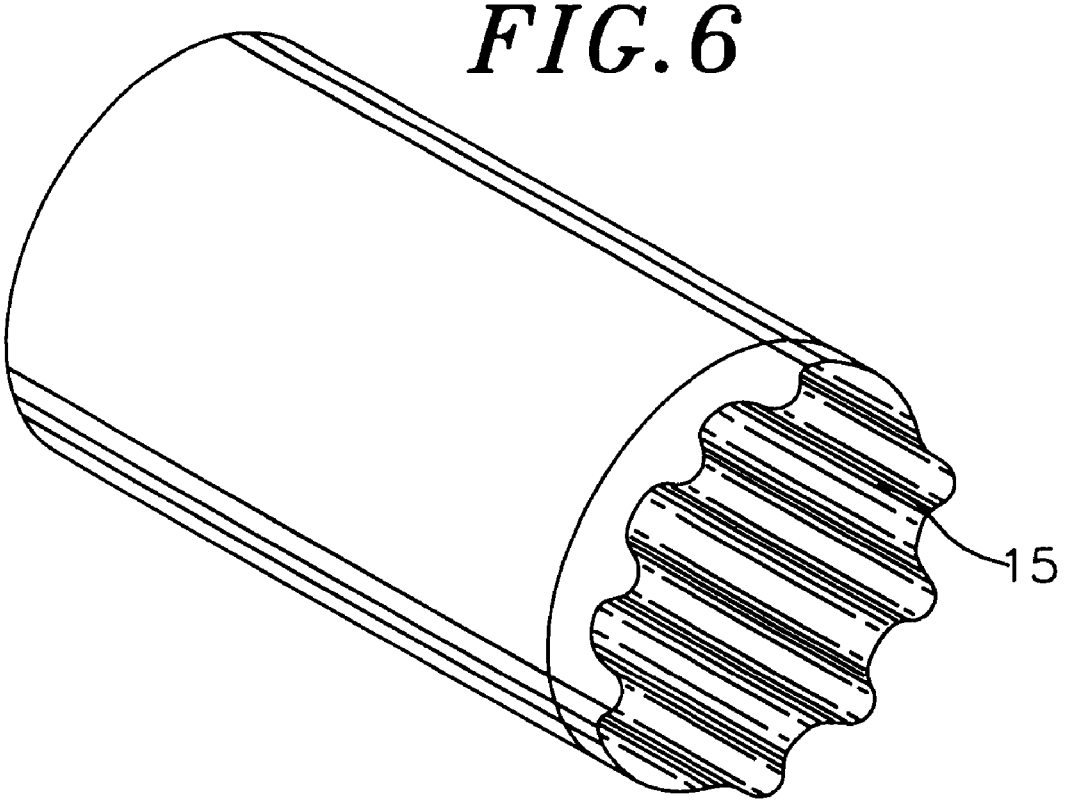
FIG. 6 is an isometric view of a PDC cutter having a PDC layer having a non-planar cutting surface.

A primary cutting surface is formed by sintering a PDC layer 14 on the top end of the uppermost wafer 22 (i.e., the top end of the cutter). The uppermost wafer may have a non-planar uppermost surface 13 (e.g., a surface having irregularities formed on it) forming the cutting face of the body onto which is bonded the PDC layer (FIG. 2B). A non-planar cutting face provides for a greater area for bonding the PDC layer. In addition, the non-planar face provides for more a gradual transition from the carbide to the diamond. Consequently, the shift in the coefficient of thermal expansion from the carbide to the diamond is also made more gradual. As a result, the magnitude of the stresses generated on the interface between the PDC layer and the carbide are reduced. To form the PDC layer, typically, diamond is spread over the surface and sintered in a high temperature, high pressure press to form polycrystalline diamond. The outer diamond surface 15 may also be non-planar as shown in FIG. 6.

Figure 2C:
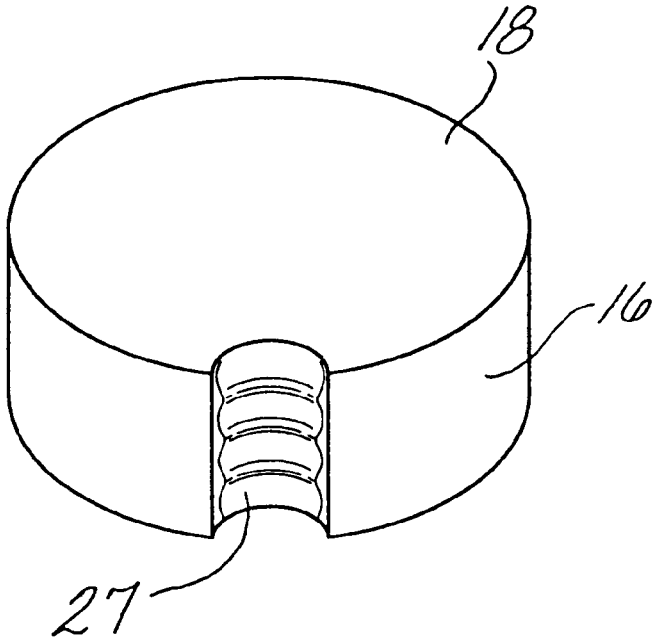
FIG. 2C is an isometric view of a PDC cutter wafer having a groove having an nonsmooth surface.

Additional cutting surfaces 24 (referred herein as "secondary" cutting surfaces) are formed on the cutter body. To form the secondary cutting or wear surfaces, grooves 26 are formed on the wafer circumferential outer surface. Preferably, the grooves span the full length of the wafers. The grooves may have irregular (e.g., wavy) surfaces 27 (FIG. 2C). Grooves having an irregular surface provide a greater area for bonding the diamond material. Moreover, the irregular surfaces provide for more a gradual transition from the carbide to the diamond. Consequently, the shift in the coefficient of thermal expansion from the carbide to the diamond is also made more gradual. As a result, the magnitude of the stresses generated on the interface between the diamond and the carbide are reduced.

Grooves which span the full length of the wafer are easier to form since the groove can begin and end at an end face 18, 20 of a wafer. As a result, the grooves have maximum depth from their onset.

The process of forming the grooves and the subsequent process of compacting and sintering polycrystalline diamond in these grooves is known in the art. Typically, the sintering occurs in a high temperature, high pressure press. For example, U.S. Pat. No. 5,031,484 describes a process for fabricating helically fluted end mills with PDC cutting surfaces by sintering and compacting polycrystalline diamond in helically formed grooves in fluted end mills. Generally speaking, the grooves for polycrystalline diamond have a half round cross section without sharp comers. Typically a groove may be 0.060 inch wide and 0.050 inch deep.

Figure 3A:
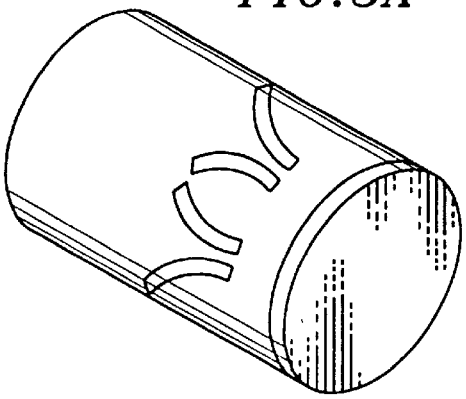
FIG. 3A is an isometric view of a PDC cutter having curve shaped secondary cutting surfaces.
Figure 3D:
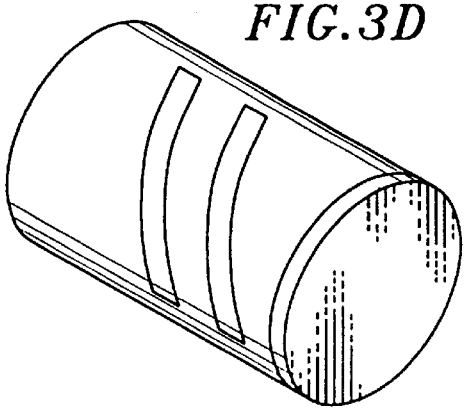
FIG. 3D is an isometric view of a PDC cutter having skewed arc shaped secondary cutting surfaces.
Figure 3B:
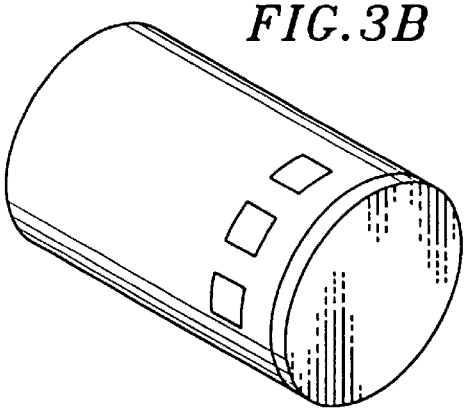
FIG. 3B is an isometric view of a PDC cutter having square shaped secondary cutting surfaces.
Figure 3C:
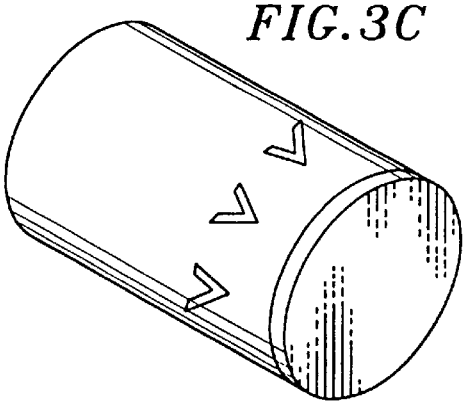
FIG. 3C is an isometric view of a PDC cutter having inverted "V" shaped secondary cutting surfaces.

The secondary cutting surface shape is driven by the shape of the groove on which it is formed. Secondary cutting surfaces can be in the shape of rings, arcs, dots, triangles, rectangles, squares (FIG. 3B). Moreover, they can be in the shape of an inverted "V" (FIG. 3C), they can be longitudinal, circumferential, curved (FIG. 3A) or skewed (FIG. 3D). The shapes of the cutting surfaces that can be formed is basically unlimited. A combination of cutting surface shapes may be incorporated in single wafer or a single cutter body.

Figure 4:
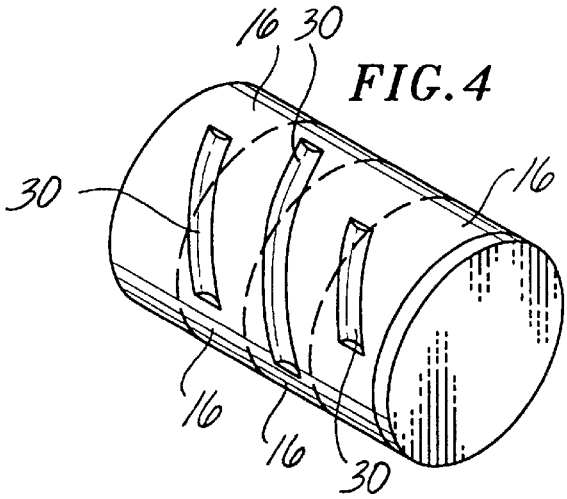
FIG. 4 is an isometric view of a PDC cutter formed from four cemented carbide wafers where the grooves on the wafers are aligned to form continuous grooves along the cutter body.
Figure 5:
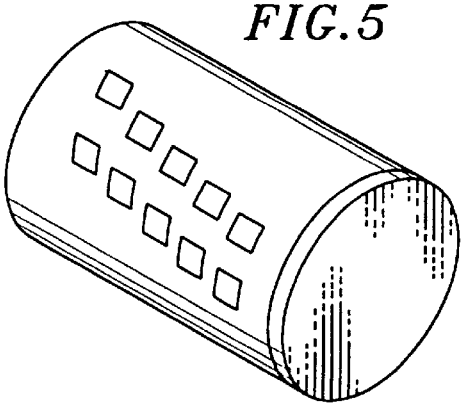
FIG. 5 is an isometric view of a PDC cutter with a plurality of square shaped secondary cutting surfaces oriented in a helical pattern.

Furthermore, the groove (and secondary cutting surface) orientation may be varied by rotating the wafers in relation to each other prior to bonding. For example, the wafers may be aligned such that the grooves are aligned forming a continuous groove 30 that are between the wafers 16 (FIG. 4). The secondary cutting surfaces can be oriented along the cutter body, as necessary, to accommodate the task at hand. For example, the secondary cutting surfaces can be oriented in a helical pattern along the length of the cutter (FIG. 5).

Moreover, the cutting surfaces can be arranged on the cutter body so as to vector the cutting forces applied by the cutter as needed for the cutting to be accomplished. Additionally, grooves, and thereby secondary cutting surfaces, of various shapes may be formed in a single wafer. Similarly, each wafer may have grooves of different shapes.

The carbide wafers can be made of different grades of cemented carbide. For example, a stiff (i.e., hard) substrate is desired to support the primary PDC cutting layer so as to prevent breakage of the PDC layer. However, with a stiff, hard substrate some toughness may be sacrificed. As a result, cracks forming at the cutting face 15 of the primary PDC cutting layer may propagate through the length of the substrate resulting in the splitting of the substrate and failure of the cutter.

To alleviate this problem and to provide the desired stiffness for prolonging the life of the PDC cutting layer and for enhancing its cutting performance, at least a wafer made from stiff cemented carbide and a wafer made from tough cemented carbide are bonded to form the substrate (body) of the cutter. A harder stiffer carbide may include an average particle size of less than 4 microns and a cobalt content of 12% by weight or less. A tougher grade of carbide will exceed these values. The toughness and hardness of the carbide is also a function of the binder material used (e.g., Ti, Co, Ni) as well as the weight % and/or the constituents of eta phase that make up the carbide. Moreover, the toughness and hardness of the carbide material may vary from supplier to supplier.

The stiffer cemented carbide wafer forms the top of the cutter for supporting the primary PDC cutting layer. The tougher cemented carbide wafer is bonded to the stiffer wafer to form the lower portion of the cutter body. The stiffer wafer provides the desired support to the PDC layer. The tougher cemented carbide wafer which is not as prone to cracking as the stiffer wafer, serves as a crack arrestor. Thus, a crack that propagates through the stiffer wafer should be arrested once it reaches the tougher wafer, preventing the failure of the cutter.

As it will become apparent to one skilled in the art, multiple wafers of various grades of cemented tungsten carbides, dual phase ("DP") carbides such as carbides with high volume % eta phase, ceramic metals commonly referred to as "cermets" or other carbides may be used to form cutters tailored to the task at hand. By varying the grade and type of the cemented carbide, the peak stress magnitude on the cutter may be decreased and the stress distribution along the cutter body may be optimized so as to yield a cutter with an enhanced operating life. In addition, each secondary cutting surface may be formed from different grades of diamond to optimize the cutting efficiency of the cutter.

Since the grooves formed on the wafers can have a full depth at their onset, the cutting surfaces formed within such grooves will have a full thickness throughout their length. Consequently, as the substrate around a secondary cutting surface wears, a cutting surface of significant thickness will always be exposed reducing the risk of cutter cracking or breakage.

The present invention, therefore, provides a modular approach to cutter design. The approach allows for the formation of a cutter with various shapes of secondary cutting surfaces, with secondary cutting surfaces of different diamond grades, and with substrates of multiple grades of cemented carbide, allowing for the optimization of the stress distribution within the cutter and for the vectoring of cutting forces applied by the cutter which result in enhanced cutter performance and life.

In a preferred embodiment, the wafers are stacked together, the grooves are compacted with the appropriate grade of diamond, and diamond is spread on the top end of the uppermost wafer, forming an assembly. The assembly is then pressed together under high temperature, high, pressure, bonding the wafers together and forming a cutter body and sintering the diamond to form a PDC layer in the cutter body top end and secondary PDC cutting surfaces on the grooves. After pressing, the carbide may be ground away, exposing additional portions of the secondary cutting surfaces to allow for enhanced cutting.

In alternate embodiment, the wafers are diffusion bonded together to form the cutter body such as by HIPing. In yet a further embodiment the wafers are brazed together using conventional methods. As it would be apparent to one skilled in the art, the wafers may be bonded with any of the aforementioned methods prior or after the compacting and sintering of the diamond material in the grooves. Similarly, the primary PDC cutting layer may be sintered prior or after the bonding of the wafers.

In another embodiment, the wafers used may be in a green state prior to bonding with the other wafers or prior to the sintering of the PDC material. Is such a case, the wafers themselves are sintered during the bonding process or during the sintering of the PDC process.

Having now described the invention as required by the patent statutes, those skilled in the art will recognize modifications and substitutions to the elements of the embodiment disclosed herein. For example, a secondary cutting surface may be employed on a cylindrical compact brazed to a cutter stud as used in some types of rock bits. Such modifications and substitutions are within the scope of the present invention as defined in the following claims.

I claim:

1. A PDC cutter comprising:

a body comprising at least two grades of cemented carbide and an end face;

a polycrystalline diamond layer on the end face of the body; and a plurality of grooves formed in the body wherein the plurality of grooves are packed with polycrystalline diamond, wherein the grade of diamond in a first groove is different from the grade of diamond in a second groove.

2. A cutter as recited in claim 1 wherein one of said grooves has an irregular surface.

3. A cutter as recited in claim 1 wherein one of said grooves has a cross-sectional shape selected from the group consisting of inverted "V"s, squares, curves and skewed arcs.

4. A cutter as recited in claim 1 wherein the end face of the body is non-planar.

5. A cutter as recited in claim 1 wherein an outer surface of the diamond layer is non-planar.

6. A cutter as recited in claim 1 wherein a first grade of cemented carbide is located nearest the polycrystalline diamond layer and wherein the first grade of cemented carbide is stiffer than a second grade of cemented carbide remote from the polycrystalline diamond layer.

7. A cutter as recited in claim 6 wherein the second grade of cemented carbide is tougher than the first grade of cemented carbide.

8. A cutter as recited in claim 6 wherein the first grade of cemented carbide comprises a particle size of less than 4 microns and a cobalt content of not greater than 12% by weight.

9. A cutter as recited in claim 6 wherein the second grade of cemented carbide comprises a particle size of at least 4 microns and a cobalt content greater than 12% by weight.

10. A cutter as recited in claim 1 wherein at least one grade of carbide is selected from the group consisting essentially of dual phase carbides and cements.

11. A PDC cutter comprising:

a first cylindrical wafer having a cylindrical outer surface;

a second cylindrical wafer having a cylindrical outer surface;

a groove formed on the cylindrical outer surface of one of the the carbide wafers, the groove spanning the entire length of said one carbide wafer, wherein the first wafer is coaxially bonded to the second wafer forming a cylindrical cutter body having a groove on its outer surface;

a polycrvstalline diamond composite layer on an end face of the cutter body; and polycrystalline diamond in the groove.

12. A cutter as recited in claim 11 wherein the groove has an irregular surface.

13. A cutter as recited in claim 11 wherein the end face of the first wafer is non-planar.

14. A cutter as recited in claim 11 wherein an outer face of the polycrystalline diamond layer is non-planar.

15. A cutter as recited in claim 11 wherein the first wafer is stiffer than a second wafer.

16. A cutter as recited in claim 11 wherein a second wafer is tougher than the first wafer.

17. A cutter as recited in claim 11 wherein the first wafer comprises a particle size of less than 4 microns and a cobalt content of not greater than 12% by weight.

18. A cutter as recited in claim 11 wherein a second wafer comprises a particle size of at least 4 microns and a cobalt content of greater than 12% by weight.

19. A cutter as recited in claim 11 wherein at least one wafer comprises a carbide selected from the group consisting essentially of dual phase carbides and cements.

20. A cutter as recited in claim 11 wherein a wafer comprises a binder selected from the group consisting essentially of Ti, Co and Ni.

21. A cutter as recited in claim 11 wherein the groove has a cross-sectional shape selected from the group consisting of inverted "V"s, squares, curves and skewed arcs.

22. A cutter as recited in claim 11 further comprising a second groove formed in the outer surface of said one carbide wafer and filled with polycrystalline diamond, wherein the groove spans the entire length of said one carbide wafer.

23. A cutter as recited in claim 11 further comprising a second groove formed in the outer surface of the other of said carbide wafers and filled with polycrystalline diamond, wherein the groove spans the entire length of said other carbide wafer.

24. A cutter as recited in claim 23 wherein the first and second grooves are not aligned with each other.

25. A cutter as recited in claim 23 wherein the first and second grooves are aligned with each other forming continuous groove along the carbide wafers.

26. A PDC cutter comprising:

a cylindrical body comprising at least two coaxial cylindrical carbide wafers bonded together wherein each wafer has a length;

a polycrystalline diamond composite layer on an end face of a first wafer of cemented carbide;

a plurality of grooves formed in one of the wafers, the grooves packed with polycrystalline diamond, wherein the grade of diamond in a first groove is different from the grade of diamond in a second groove.

27. A cutter comprising:

a cemented carbide body comprising an end face;

a layer of ultra hard material on the end face of the body; and two grooves formed in the body wherein each of the grooves is packed with an ultra hard material, wherein the grade of ultra hard material in a first groove is different from the grade of ultra hard material in a second groove.

28. A cutter comprising:

a cylindrical body comprising at least two coaxial cylindrical carbide wafers bonded together wherein each wafer has a length;

a layer of ultra hard material layer on an end face of a first wafer of cemented carbide;

a first groove formed on in one of the wafers;

a second groove formed in the other wafer;

a first grade of ultra hard material filling the first groove; and a second grade of ultra hard material filling the second groove, wherein the first grade of ultra hard material is different from the second grade of ultra hard material.

* * * * *